United States Patent [19]

Okuda

[11] Patent Number: 4,976,234

[45] Date of Patent: Dec. 11, 1990

[54] INTERNAL COMBUSTION ENGINE STOP DEVICE

[75] Inventor: Hiroshi Okuda, Himeji, Japan

[73] Assignee: Mitsubishi Denki Kabushiki Kaisha, Tokyo, Japan

[21] Appl. No.: 432,840

[22] Filed: Nov. 7, 1989

[51] Int. Cl.[5] ..... F02B 77/00

[52] U.S. Cl. ..... 123/198 DC; 123/198 D

[58] Field of Search ..... 123/198 D, 198 DC

[56] References Cited

U.S. PATENT DOCUMENTS

| | | | |
|---|---|---|---|
| 3,960,128 | 6/1976 | Anderson et al. | 123/198 DC |
| 4,073,279 | 2/1978 | Fox | 123/198 DC |
| 4,193,385 | 3/1980 | Katsumota et al. | 123/198 DC |

FOREIGN PATENT DOCUMENTS 60-40871 12/1985 Japan .

*Primary Examiner*—Noah P. Kamen

*Attorney, Agent, or Firm*—Sughrue, Mion, Zinn, Macpeak and Seas

[57] ABSTRACT

An internal combustion engine stop device comprises a power generation winding 1 for generating electric power corresponding to the rotation of an engine to charge a capacitor 2 for an ignition coil 4; a self-reset type stop switch 11 having normally opened contacts; a self-holding circuit 24 for bringing the output of the power generation winding to a short-circuit state and holding the short-circuit state; and voltage restraint or malfunction prevention elements 32, 36–38 arranged between the stop switch and the power generation winding to restrain a voltage applied to the stop switch.

3 Claims, 2 Drawing Sheets

INTERNAL COMBUSTION ENGINE STOP DEVICE

BACKGROUND OF THE INVENTION

1. FIELD OF THE INVENTION

The present invention relates to an internal combustion engine stop device having an electrical self-holding function.

2. DISCUSSION OF BACKGROUND

FIG. 2 is a schematic circuit diagram showing the structure of a conventional internal combustion engine stop device. In FIG. 2, reference numeral 1 designates a power generation winding which is driven by an engine (not shown) to generate an a.c. output. Reference numeral 2 designates a capacitor for an ignition winding, which is charged through a diode 3 by one of the polarity outputs of the a.c. power generation winding 1. Reference numeral 4 designates an ignition coil whose secondary winding is connected to an ignition plug 5. Reference numeral 6 designates a signal winding which generates an ignition signal in synchronism with the rotation of the engine. The output of the signal winding is applied to the gate of a thyristor 8 through a diode 7. Reference numeral 9 designates a bias resistor which is connected between the gate and the cathode of the thyristor 8. Reference numeral 10 designates a diode which is connected in parallel with the primary coil of the ignition winding 4 to bypass the counter-electromotive force caused in the ignition coil 4.

Reference numeral 11 designates a self-reset type stop switch which has normally opened contacts. The switch has one terminal connected to a stop circuit 12 and the other terminal grounded. Reference numeral 13 designates a thyristor in the stop circuit 12, whose anode is connected to one end of the power generation winding 1, and whose cathode is grounded through a resistor 14 and a diode 15. The gate of the thyristor 13 is connected to the cathode of a diode 17 through a resistor 16. Between the gate and the cathode of the thyristor 13 is connected a resistor 18. Reference numerals 19 and 20 designate a diode and a capacitor, respectively, which are connected in series so as to be in parallel with the resistor 14. The junction between the diode 19 and the capacitor 20 is connected to the anode of the diode 17, and also connected to the one terminal of the stop switch through a diode 21 which is reversely connected. The junction between the capacitor 20 and the resistor 14 is connected to the one end of the power generation winding 1 through a diode 22.

In operation, when the engine rotates, the power generation winding 1 generates an a.c. output, and charges the capacitor 2 through the diode 3 by the one polarity output (b direction voltage). The signal winding 6 outputs the ignition signal corresponding to a predetermined ignition timing, thereby causing the thyristor 8 to conduct. The conduction of the thyristor 8 discharges the charge stored in the capacitor 2 to the primary winding of the ignition coil 4, causing a high voltage to generate in the primary winding. As a result, a spark discharge is caused in the ignition plug 5.

During the normal operation of the engine, the stop switch 11 is opened, and the thyristor 13 in the stop circuit 12 does not conduct. As a result, the output of the power generation winding 1 is supplied to the capacitor 2 without being brought to a short-circuit state. In this way, the normal ignition operation is carried out.

When the stop switch 11 is closed, the other polarity output (a direction voltage) generated by the power generation winding 1 flows in the route of the stop switch 11, the diode 21, the capacitor 20, the diode 22 and the power generation winding 1, thereby charging the capacitor 20. When the power generation winding 1 generates the b direction voltage output, the charge stored in the capacitor 20 is discharged through the diode 17, the resistor 16, the junction between the gate and the cathode of the thyristor 13, and the resistor 14, allowing the thyristor 13 to conduct. As a result, the b direction voltage generated by the power generation winding 1 is brought to a short-circuit stage through the thyristor 13, the resistor 14 and the diode 15. In this way, the b direction voltage of the generation winding 1 is not applied to the capacitor 2, causing the ignition operation to stop. The voltage which flows across the resistor 14 at the time of bringing the b direction voltage to the short-circuit stage recharges the capacitor 20 through the diode 19, and the discharge as just mentioned is repeated. This allows the thyristor 13 to remain conductive stage even if the stop switch 11 is opened. In this way, a misfire state continues until the engine has stopped.

Since the conventional internal combustion engine stop device is constructed as described above, the a direction voltage generated by the power generation winding 1 is applied to the stop switch 11 through the diode 21, the capacitor 20 and the diode 22 during the operation of the engine, i.e. when the stop switch 11 is opened. This applied voltage is at a high level. As a result, there is a problem in that the reliability of the device is low because, for example, the stop circuit 12 can be actuated when a leakage current having an extremely small value flows between the contacts of the stop switch 11 due to the deterioration in insulating properties of the stop switch 11, the wiring and the like, or the presence of a droplet or dust on the stop switch 11.

SUMMARY OF THE INVENTION

It is an object of the present invention to overcome the problem of the conventional internal combustion engine stop device and to provide a new and improved internal combustion engine stop device capable of carrying out the stop operation in good reliability.

The foregoing and other objects of the present invention have been attained by providing an internal combustion engine stop device comprising a power generation winding for generating electric power corresponding to the rotation of an engine to charge a capacitor for an ignition winding; a self-reset type stop switch having normally opened contacts; a self-holding circuit for bringing the output of the power generation winding to a short-circuit state and holding the short-circuit state; and voltage restraint means arranged between the stop switch and the power generation winding to restrain a voltage applied to the stop switch.

As a result, the voltage across the opened contacts of the stop switch is restrained to a predetermined low level to prevent the stop operation from being erroneously made even if a leakage current flows between the contacts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
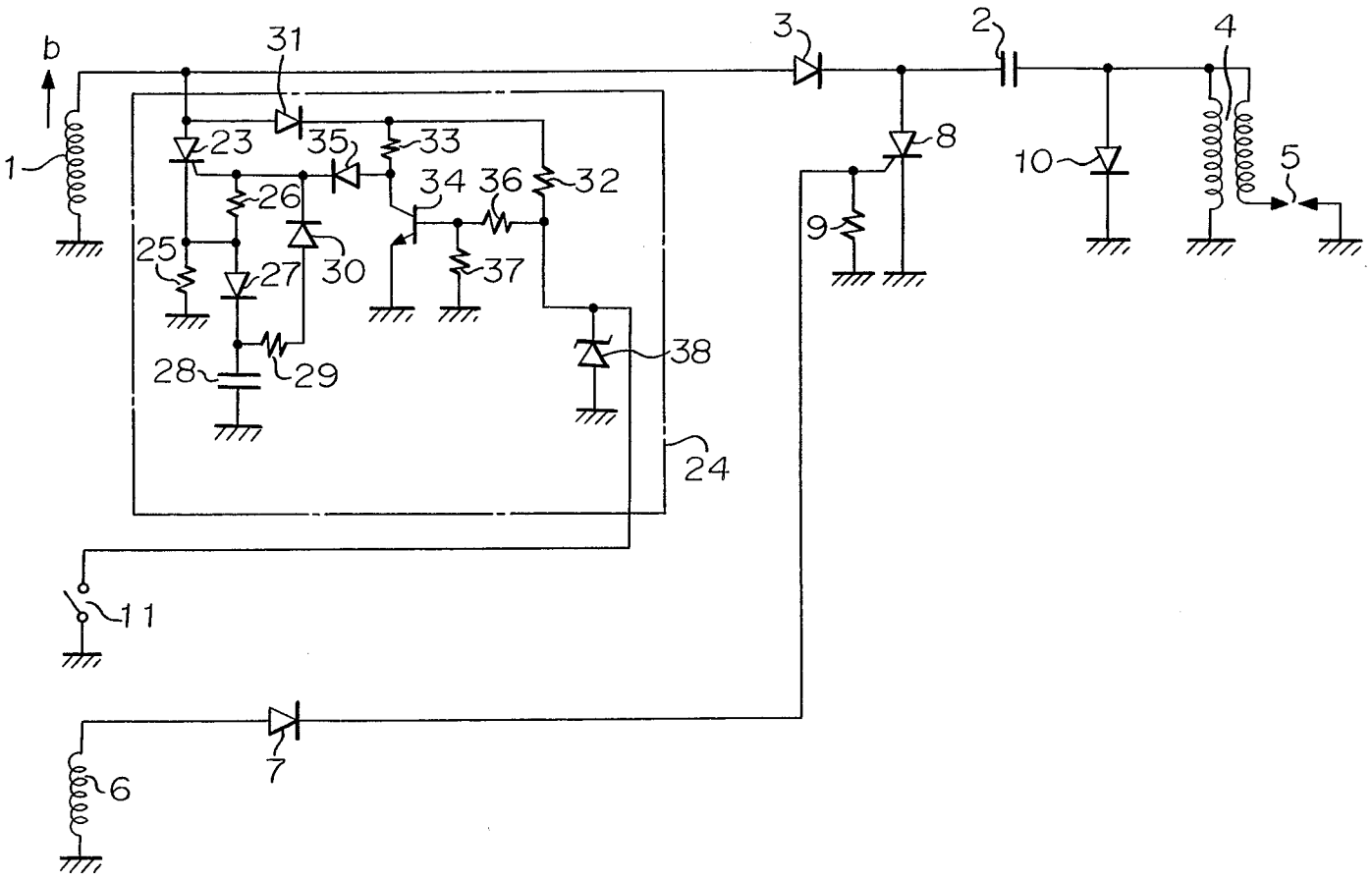
FIG. 1 is a schematic circuit diagram of the internal combustion engine stop device according to an embodiment of the present invention.
Figure 2:
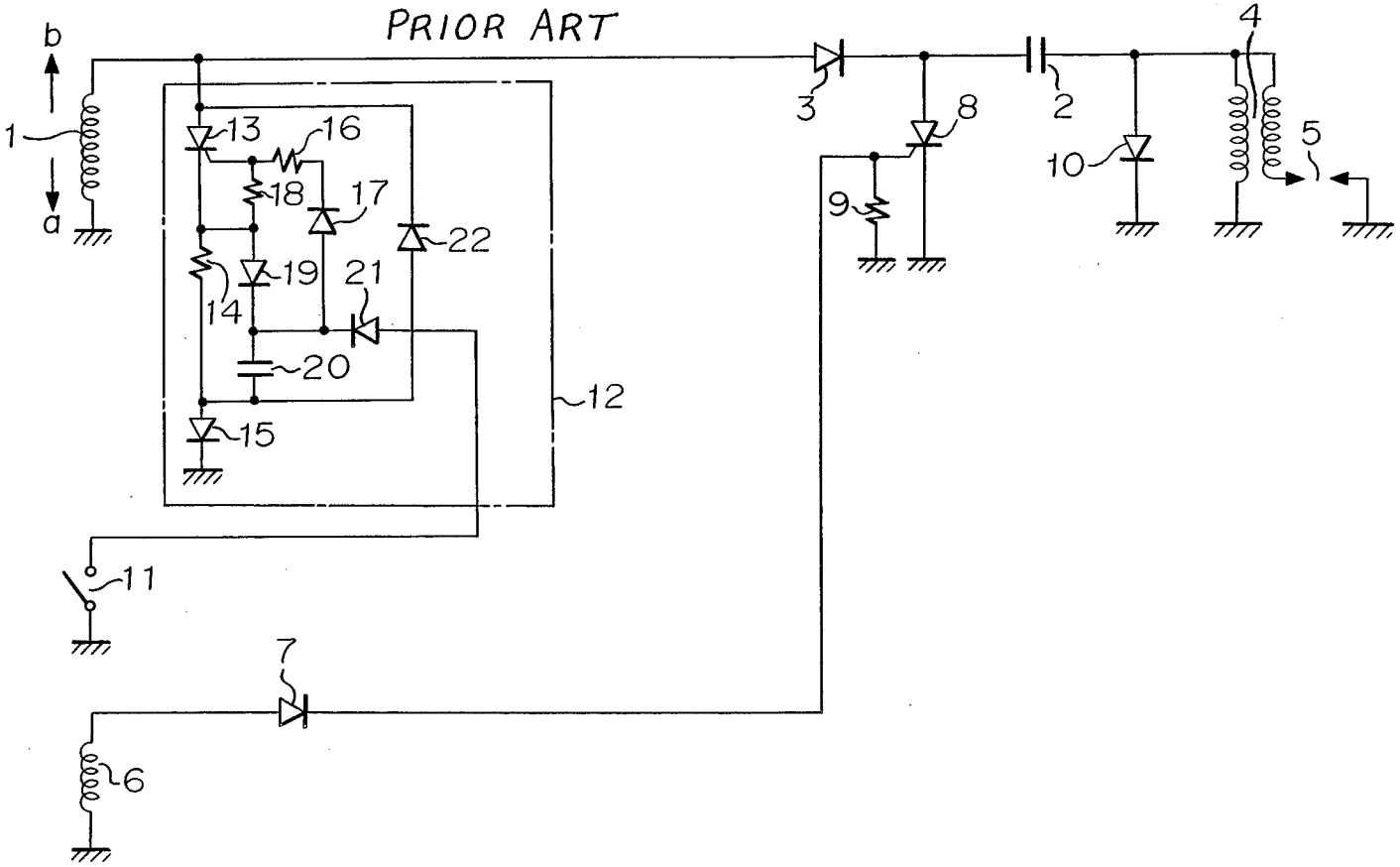
FIGURE 2 PRIOR ART
FIG. 2 is a schematic circuit diagram of a conventional internal combustion engine stop device.

Now, the present invention will be described in detail with reference to a preferred embodiment illustrated in the accompanying drawing. In FIG. 1, parts indicated by reference numerals 1 through 11 are the same as those of the conventional device as shown in FIG. 2. Explanation on such parts will be omitted for the sake of clarity. Reference numeral 23 designates a thyristor in a stop circuit 24, whose anode is connected to one end of the power generation winding 1, and whose cathode is grounded through a resistor 25. Between the gate and the cathode of the thyristor 23 is connected a resistor 26. A series combination of a diode 27 and a capacitor 28 is connected in parallel to the resistor 25. The junction between the diode 27 and the capacitor 28 is connected to the gate of the thyristor 23 through a resistor 29 and a diode 30. Reference numeral 31 and 32 designate a diode and a resistor, respectively, which are arranged between the one end of the power generation winding 1 and one terminal (non-grounded terminal) of the stop switch. The junction between the diode 31 and the resistor 32 is connected to the collector of a transistor 34 through a resistor 33. The collector of the transistor 34 is connected to the gate of the thyristor 23 through a diode 35. The base of the transistor 34 is connected to the one end of the stop switch 11 through a resistor 36, and also is grounded through a resistor 37. The emitter of the transistor 34 is grounded. Reference numeral 38 designates a Zener diode which is connected between the conduction path from the resistor 32 to the stop switch 11, and ground. The Zener diode 38 and the resistors 32, 36 and 37 constitute voltage restraint means.

Next, the operation of the internal combustion engine stop device having the structure described above will be explained. During the normal operation of the engine, the stop switch 11 is kept opened, and the small b direction voltage generated by the power generation winding 1 is applied to the base of the transistor 34 through the diode 31 and the resistors 32 and 36, causing the transistor 34 to conduct. As a result, the current which flows through the resistor 33 is bypassed to ground through the transistor 34 to prevent the thyristor 23 from being triggered.

On the other hand, when the stop switch 11 is closed, the current which flows through the resistor 32 is bypassed to ground to drive the transistor 34 to cutoff. The current which flows through the resistor 33 is applied now to the gate of the thyristor 23 through the diode 35, allowing the thyristor 23 to conduct. As a result, the small b direction voltage generated by the power generation winding 1 is brought to a short-circuit state through the thyristor 23 and the resistor 25. At this time, the voltage across the resistor 25 charges the capacitor 28. After that, the charge stored in the capacitor 28 is supplied to the gate of the thyristor 23 through the resistor 29 and the diode 30 to keep the thyristor 23 in conduction like the conventional device. Keeping the thyristor 23 in conduction is held until the engine has stopped. In this way, closing the stop switch 11 allows the output of the power generation winding 1 to be self-held in such short-circuit state.

The voltage which is applied to the stop switch 11 at the time of opening the switch is restrained to a predetermined low voltage which is determined by the predetermined values of the resistors 32, 36 and 37 and the Zener voltage of the Zener diode 38 and which is lower than the power output (b direction voltage) generated by the power generation winding 1. As a result, even if leakage current flows in the stop switch 11, the stop circuit 24 can be prevented from malfunctioning.

Although in the embodiment as just explained the voltage restraint means uses the resistors 32, 36 and 37, and the Zener diode 38, the voltage restraint means can be constituted by only the resistors 32, 36 and 37 by selecting the resistors 32, 36 and 37 having predetermined suitable values.

In accordance with the present invention, there is provided the voltage restraint means for restraining the voltage applied to the stop switch. This can prevent the malfunction which can be caused by the deterioration in insulating properties of the stop switch or the wiring, or by the occurrence of the leak resistance between the contacts, offering the stop device having high reliability.

Obviously, numerous modifications and variations of the present invention are possible in light of the above teachings. It is therefore to be understood that within the scope of the appended claims, the invention may be practiced otherwise than as specifically described herein.

What is claimed is:

1. An internal combustion engine stop device comprising:

a power generation winding (1) for generating electric power corresponding to the rotation of an engine to charge a capacitor (2) for an ignition coil (4);

a self-reset type stop switch (11) having normally opened contacts;

a self-holding circuit (24) including a shunting thyristor (23) and a triggering capacitor (28) coupled to a gate of the thyristor for short-circuiting the output of the power generation winding and for holding the winding in a short-circuited state in response to a momentary closure of the stop switch; and malfunction prevention means arranged between the stop switch and the power generation winding for preventing leakage current across the stop switch from charging the triggering capacitor and attendantly preventing the erroneous gating of the thyristor and the shut down of the engine.

2. An internal combustion engine stop device according to claim 1, wherein the malfunction prevention comprises resistors.

3. An internal combustion engine stop device according to claim 2, wherein the malfunction prevention means further comprises a Zener diode.

* * * * *